US010619440B2

(12) United States Patent
Noske, Jr. et al.

(10) Patent No.: US 10,619,440 B2
(45) Date of Patent: Apr. 14, 2020

(54) COMMUNICATION THROUGH A HANGER AND WELLHEAD

(71) Applicant: WEATHERFORD TECHNOLOGY HOLDINGS, LLC., Houston, TX (US)

(72) Inventors: Joe Noske, Jr., Houston, TX (US); Christopher L. McDowell, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 111 days.

(21) Appl. No.: 15/588,536

(22) Filed: May 5, 2017

(65) Prior Publication Data

US 2018/0320506 A1 Nov. 8, 2018

(51) Int. Cl.

| | |
|---|---|
| ***E21B 33/038*** | (2006.01) |
| ***E21B 17/02*** | (2006.01) |
| ***E21B 47/10*** | (2012.01) |
| ***H01R 13/00*** | (2006.01) |
| ***E21B 33/04*** | (2006.01) |
| ***E21B 47/12*** | (2012.01) |
| ***E21B 33/035*** | (2006.01) |

(52) U.S. Cl.

CPC ..... *E21B 33/0385* (2013.01); *E21B 17/02* (2013.01); *E21B 17/023* (2013.01); *E21B 33/0355* (2013.01); *E21B 33/04* (2013.01); *E21B 33/0407* (2013.01); *E21B 47/1025* (2013.01); *E21B 47/12* (2013.01); *H01R 13/005* (2013.01)

(58) Field of Classification Search

CPC ..... E21B 33/04; E21B 33/047; E21B 47/047; E21B 47/12; E21B 17/02; E21B 47/1025

See application file for complete search history.

(56) References Cited

U.S. PATENT DOCUMENTS

2001/0042624 A1* 11/2001 Bartlett ..... E21B 33/0355 166/368
2007/0256829 A9 11/2007 Hosie et al.
2008/0060846 A1* 3/2008 Belcher ..... E21B 17/042 175/25

(Continued)

FOREIGN PATENT DOCUMENTS

GB 2333307 A 7/1999

OTHER PUBLICATIONS

UK Combined Search Report and Examination Report dated Oct. 15, 2018 for UK Patent Application No. GB1807404.7, 7 pages.

*Primary Examiner* — David J Bagnell
*Assistant Examiner* — Manuel C Portocarrero
(74) *Attorney, Agent, or Firm* — Smith IP Services, P.C.

(57) ABSTRACT

A system for communicating through a hanger can include an alignment manifold having upper and lower terminals positioned on opposite respective sides of the alignment manifold, each of the upper terminals being in communication with a respective one of the lower terminals. A downhole line connector can be configured to connect to downhole lines, the downhole line connector including terminals aligned with the lower terminals of the alignment manifold. A method of communicating through a hanger can include connecting an alignment manifold to the hanger, the hanger being configured to suspend a tubular from a wellhead assembly, and connecting a downhole line connector to the alignment manifold.

37 Claims, 13 Drawing Sheets

(56) References Cited

U.S. PATENT DOCUMENTS

| | | | |
|---|---|---|---|
| 2008/0302524 | A1 | 12/2008 | Hosie et al. |
| 2015/0159458 | A1 | 6/2015 | Tan et al. |
| 2016/0281465 | A1 | 9/2016 | Grayson et al. |
| 2016/0319637 | A1 | 11/2016 | McDowell et al. |
| 2017/0089157 | A1 | 3/2017 | Noske |
| 2017/0211339 | A1* | 7/2017 | Emerson ..... E21B 17/003 |

* cited by examiner

COMMUNICATION THROUGH A HANGER AND WELLHEAD

BACKGROUND

This disclosure relates generally to equipment utilized and operations performed in conjunction with subterranean wells and, in examples described below, more particularly provides for communication through a hanger and a wellhead.

It can be desirable to be able to communicate with equipment, tools, sensors, etc., through a wellhead. For example, electrical lines (such as, power, data and/or command signal-conducting lines), fluid lines (such as, pneumatic, hydraulic, chemical injection, pressurized or pressure-balanced lines), or other lines could be extended between an interior and an exterior of the wellhead.

In some situations, it may be desired to communicate with downhole tools, such as, tools connected in a tubular string installed in a well. Lines (such as control lines) extending to the downhole tools may also be connected to surface equipment, in which case the lines could extend through the wellhead between the surface equipment and the downhole tools.

It will, therefore, be appreciated that improvements are continually needed in the art of designing, constructing and utilizing systems and apparatus for communicating through a hanger and wellhead. Such improvements may be useful whether or not communication is provided with downhole tools or any other particular equipment, sensors, etc., within the wellhead or positioned downhole.

DETAILED DESCRIPTION

Figure 1:
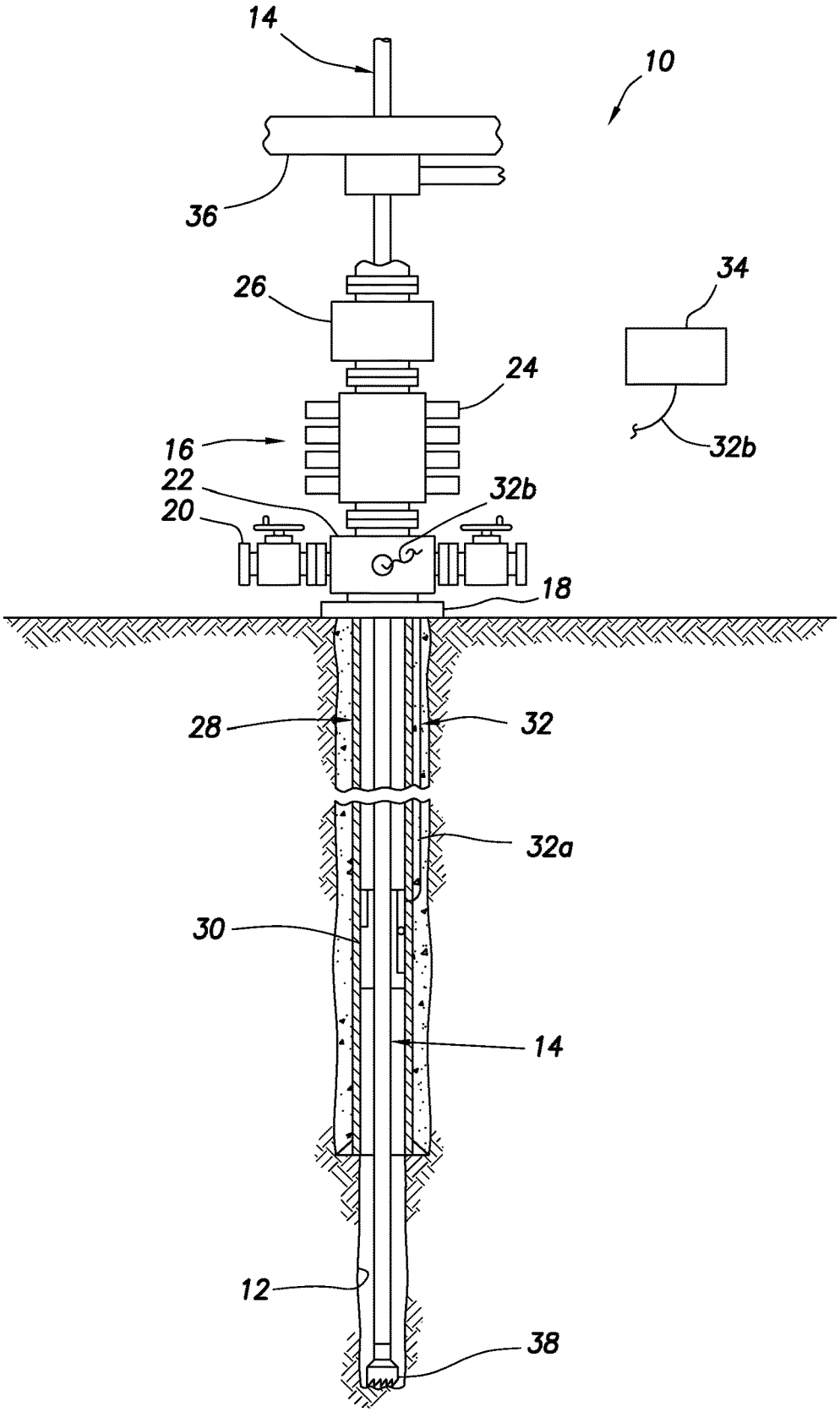
FIG. 1 is a representative partially cross-sectional view of an example of a well system and associated method which can embody principles of this disclosure.

Representatively illustrated in FIG. 1 is a well system 10 and associated method which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a wellbore 12 is being drilled by a drill string 14 extending through a wellhead assembly 16 at surface. The wellhead assembly 16 in this example includes a wellhead 18, various valves 20, various spools or housings 22, rams 24 and an annular blowout preventer 26. However, the scope of this disclosure is not limited to use of any particular equipment or combination of equipment on or with a wellhead assembly.

Although FIG. 1 depicts a drilling operation, it is not necessary for a well to be drilled while the principles of this disclosure are practiced. For example, the well may have already been completed when the principles of this disclosure are practiced. Thus, the scope of this disclosure is not limited to drilling operations.

The drill string 14 may be rotated at surface, for example, using a top drive (not shown) or a rotary table incorporated into a rig floor 36. A drill bit 38 connected at a distal end of the drill string 14 may also, or alternatively, be rotated by use of a drill motor (not shown) connected in the drill string above the drill bit.

Note that the term "surface" is used herein to refer to locations at or near the earth's surface, whether covered by water or on dry land. Thus, a subsea wellhead assembly would be located at surface, as would a wellhead assembly suspended from a floating rig, or a wellhead assembly on dry land.

As depicted in FIG. 1, the drill string 14 extends through a casing string 28 cemented in the wellbore 12. Although only a single casing string 28 is illustrated in FIG. 1, any number of casing strings may be used. In the case of multiple casing strings, the casing string 28 may be an inner, outer or intermediate casing string.

Connected as part of the casing string 28 is a downhole tool 30. In this example, the downhole tool 30 is of the type known to those skilled in the art as a downhole deployment valve or a downhole isolation valve.

The downhole tool 30 functions to selectively permit and prevent fluid flow between the interior of the casing string 28 below and above the downhole tool. During drilling operations, a downhole deployment valve or a downhole isolation valve can be used to isolate an open hole portion of the wellbore 12 from pressures in the casing string 28 above the tool 30, and can be used to prevent flow from the open hole portion of the wellbore 12 to the casing string 28 above the tool 30. Suitable tools for use as the downhole tool 30 are described in U.S. publication nos. 2017/0089157, 2016/0319637 and 2016/0281465.

However, it should be clearly understood that the downhole tool 30 depicted in FIG. 1 is merely one example of a tool or item of equipment to which lines 32 may extend in a well. The lines 32 could connect to other types of tools and equipment in other examples. A sensor (not shown) could be connected to the lines 32, various types of actuators could be connected to the lines 32, etc. Therefore, the scope of this disclosure is not limited to use of any particular type, purpose, location or combination of downhole tools, sensors, equipment, etc., connected to the lines 32.

In FIG. 1, the lines 32 comprise downhole lines 32*a* and surface lines 32*b*. The downhole lines 32*a* are connected to the downhole tool 30, in this example, to communicate optical, electrical or fluid power, control, data, etc., signals between the downhole tool and surface. The surface lines 32*b* are connected to surface equipment 34 (such as, comprising recorders, transmission equipment, instrumentation and/or a control system for controlling operation of the downhole tool 30 and evaluating its performance).

It is desired, in this example, to provide communication between the downhole tool 30 and the surface equipment 34 via the lines 32. Such communication may be in the form of optical, electrical or fluid signals transmitted and/or received by the downhole tool and/or the surface equipment. The signals may be transmitted for power delivery, control, data communication, or any other purpose.

Referring additionally now to FIGS. 2-5, an example of a system 40 for communicating through a hanger and a sidewall of a wellhead assembly is representatively illustrated. The system 40 may be used with the well system 10 and method of FIG. 1, or the system 40 may be used with other well systems and methods.

When used with the FIG. 1 well system 10, the communication system 40 can function to connect the downhole lines 32*a* to the surface lines 32*b*. In this manner, the lines 32 provide for communication between the downhole tool 30 and the surface equipment 34 through a side of the wellhead assembly 16 (e.g., between an interior and an exterior of the wellhead assembly).

Figure 2:
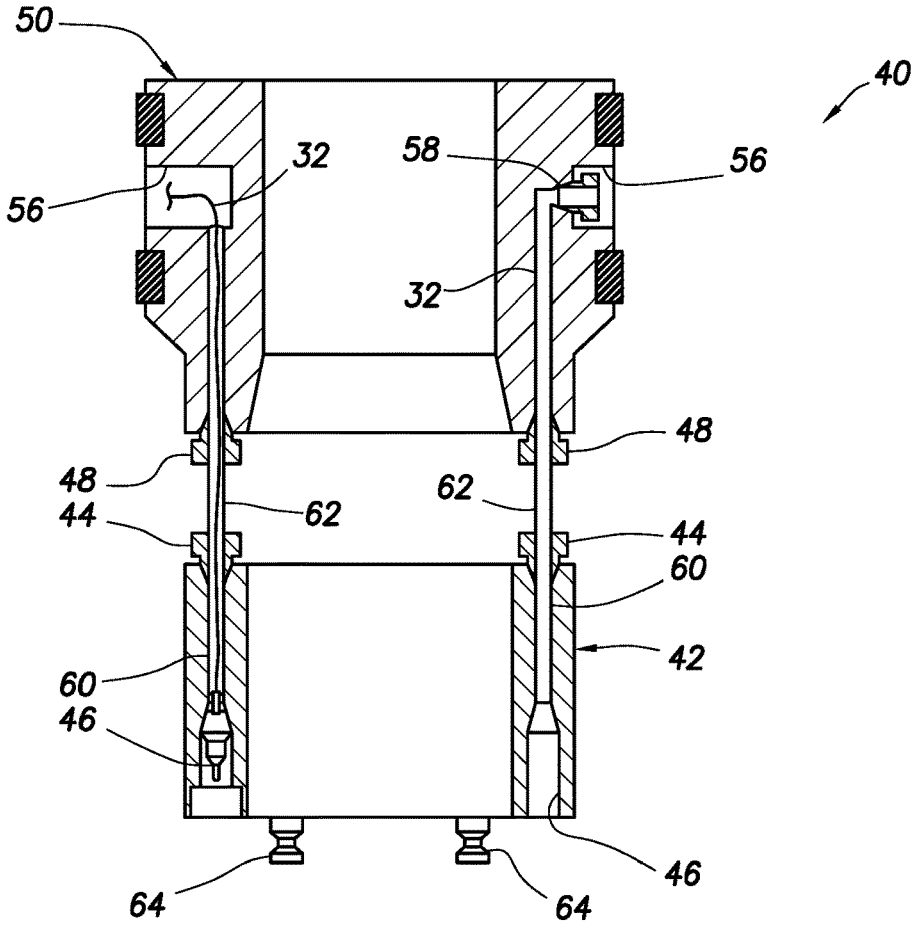
FIG. 2 is a representative cross-sectional view of an example of an assembled hanger and alignment manifold that can embody the principles of this disclosure.

As depicted in FIG. 2, the system 40 includes an alignment manifold 42 having first or upper terminals 44 and second or lower terminals 46. The upper terminals 44 are aligned with lower terminals 48 on a hanger 50.

The alignment manifold 42, in this example, can be adapted to different configurations of the hanger 50, by matching positions of the terminals 44 (e.g., radially, circumferentially and axially) to those of the terminals 48, so that the alignment manifold 42 can be conveniently connected to the hanger 50. When the terminals 44 are connected to the terminals 48, the lines 32 can extend through the connected alignment manifold 42 and hanger 50.

One result of connecting the alignment manifold 42 to the hanger 50 is that the assembled hanger and alignment manifold has the terminals 46 at its lower end. The terminals 46 are configured for efficient and reliable connection to terminals 54 of a downhole line connector 52 (see FIG. 3), as described more fully below.

In the FIG. 2 example, one of the lines 32 comprises an electrical or optical conductor for transmitting electrical or optical signals through the assembled alignment manifold 42 and hanger 50. Another one of the lines 32 comprises a fluid line (such as, a hydraulic or pneumatic line). The fluid line 32 may in different sections comprise a conduit, passageway, tube or other flow path.

The lines 32 extend to respective openings 56 in the hanger 50. In some examples, the openings 56 may provide space for containing electrical, optical and/or fluid connectors 58 for further connection to the surface lines 32*b* (see FIG. 1). In the FIG. 2 example, the connector 58 can comprise a hydraulic or pneumatic connector for providing communication with a surface fluid line 32*b*. For the optical or electrical line 32, the connector 58 may be provided as an electrical or optical connector.

Note that conduits 60 extending axially through the alignment manifold 42 provide for communication between the respective terminals 44, 46. The conduits 60 do not necessarily extend axially straight between the respective terminals 44, 46. Instead, in some examples, the terminals 44, 46 may not be aligned. For example, the terminals 44, 46 could be radially and/or rotationally offset from each other.

The alignment manifold 42 enables the terminals 44 to be conformed to the characteristics (e.g., positions, numbers and types of connectors, etc.) of the hanger terminals 48. In the FIG. 2 example, the terminals 44, 48 are depicted as being connected by tubes 62 releasably and sealingly secured at opposite ends to the respective terminals 44, 48. However, the scope of this disclosure is not limited to any particular means for providing communication between the respective terminals 44, 48.

The terminals 44, 48 are depicted in FIG. 2 as comprising tubing connectors, but other types of connectors may be used. For example, electrical, optical, hydraulic, pneumatic or other types of connectors may be used.

As used herein, the term "terminal" is used to indicate a provision for connecting to a line for communication with the line, typically but not necessarily at an end of the line or section of the line. A terminal may be for connecting to an electrical, hydraulic, pneumatic, optical or other type of line. A terminal may comprise a single component or multiple components.

It is not necessary, however, for separate terminals 44, 48 or connectors to be used at opposite ends of elements (such as the tubes 62) between the alignment manifold 42 and the hanger 50. In some examples, the alignment manifold 42 could be directly connected to the hanger 50, so that the lines 32 could extend through the connected alignment manifold and hanger, without use of the tubes 62.

In the FIG. 2 example, the alignment manifold 42 can be connected to the hanger 50, before the hanger is to be installed in the wellhead assembly 16, as part of an operation to install the casing string 28. The alignment manifold 42 can be connected to the hanger 50 away from the rig floor 36.

Some benefits of this include that there is less possibility of dropping tools or parts into the open well, and the alignment manifold 42 and hanger 50 can be assembled and pressure tested in an environment more suitable for these operations, prior to transporting the assembled alignment manifold and hanger to the rig floor 36 for installation in the wellhead assembly 16. The pressure testing may include applying elevated pressures to various ones of the conduits 60, tubes 62 and other passageways and flow paths in the alignment manifold 42 and hanger 50, and monitoring for pressure changes or leaks to the exterior, to the interior, between lines 32, etc. However, the scope of this disclosure is not limited to any particular pressure testing procedure, or to pressure testing as part of any particular sequence of steps.

After the alignment manifold 42 has been connected to the hanger 50, the downhole line connector 52 (see FIG. 3) can be readily connected to the alignment manifold 42. As mentioned above, the connector 52 connects the downhole lines 32*a* to respective ones of the terminals 54. The connector terminals 54 are configured for connecting to the respective terminals 46 of the alignment manifold 42.

The downhole lines 32*a* can be connected to the connector 52 away from the open well, for example, to achieve the same benefits mentioned above for connecting the alignment manifold 42 to the hanger 50 away from the open well.

Figure 3:
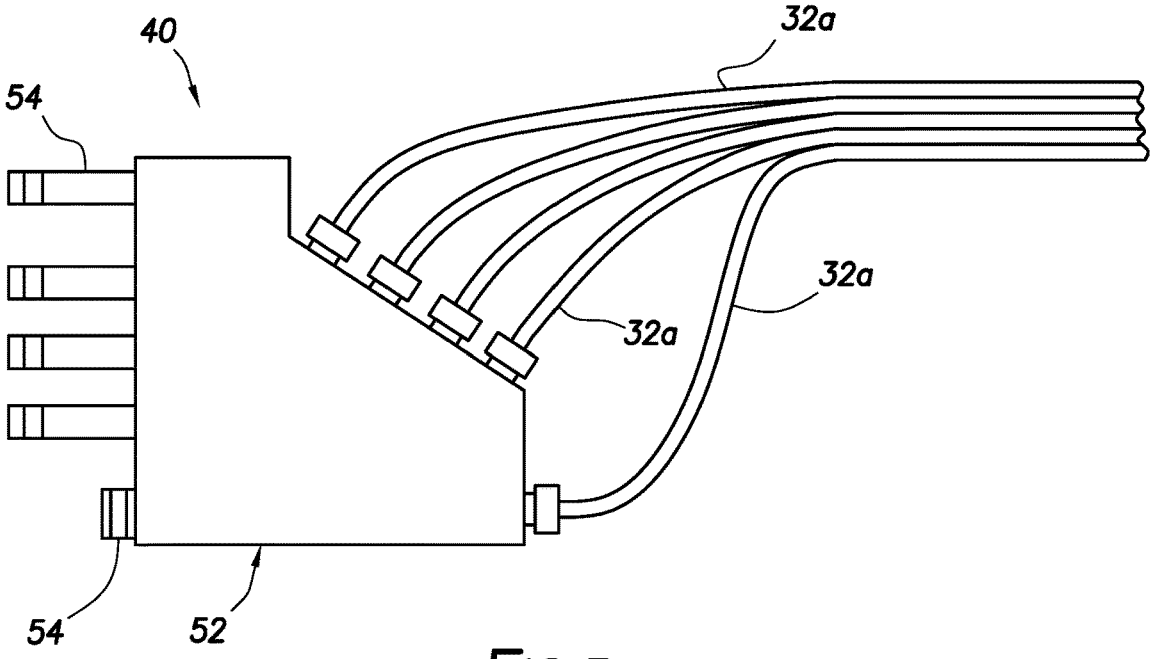
FIG. 3 is a representative side view of an example of an assembled downhole lines and connector that can embody the principles of this disclosure.

Note that, in the FIGS. 2 & 3 example, one set of respective terminals 46, 54 comprises a fluid connection, with a seal bore being formed in the alignment manifold 42, and the terminal 54 including a tubular prong configured for sealing engagement in the seal bore. Another set of respective terminals 46, 54 comprises an optical or electrical connection. The optical or electrical connection can have an associated fluid connection, to isolate the optical or electrical connection from well fluids.

Locking lugs 64 can be used to secure the alignment manifold 42 and the connector 52 together. Of course, other types of securement devices, or other ways of connecting the alignment manifold 42 and the connector 52 to each other may be used, in keeping with the principles of this disclosure. For example, the alignment manifold 42 and the connector 52 may be coupled by inserting one or more threaded shafts 82 on the alignment manifold 42 into one or more respective bores 84 in the connector 52 and securing the alignment manifold 42 to the connector 52 by threading one or more nuts 86 to the end of the one or more respective threaded shafts 82 (see FIG. 6).

Figure 4:
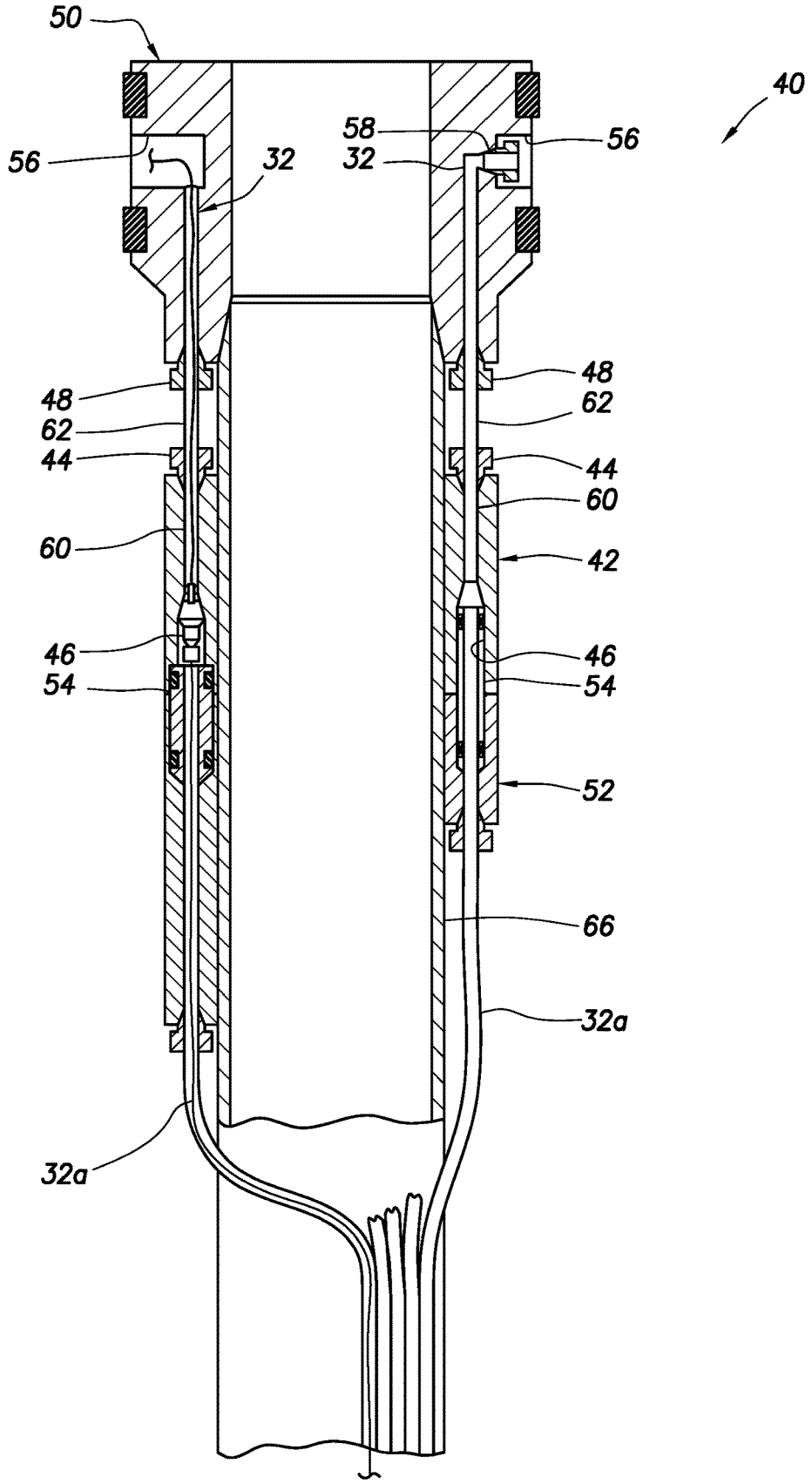
FIG. 4 is a representative partially cross-sectional view of the further assembled hanger, alignment manifold, connector and downhole lines.

As depicted in FIG. 4, the alignment manifold 42 has been connected to the connector 52. Communication is now provided for the lines 32 through the connected hanger 50, alignment manifold 42 and connector 52, including from the downhole lines 32*a* to the openings 56 in the hanger 50.

Note that a tubular 66 is connected to a lower end of the hanger 50 (such as, by threading). The hanger 50 is configured to suspend the tubular 66 in the wellhead assembly 16. The tubular 66 could in some examples be a relatively short joint of casing, such as an upper section of the casing string 28 of FIG. 1. However, the scope of this specification is not limited to any particular type of tubular being suspended by the hanger 50.

The tubular 66 could be connected to the hanger 50 at various times in the method. For example, the tubular 66 could be connected to the hanger 50 prior to or after connecting the alignment manifold 42 to the hanger 50, and prior to or after pressure testing the connected alignment manifold and hanger.

Figure 5:
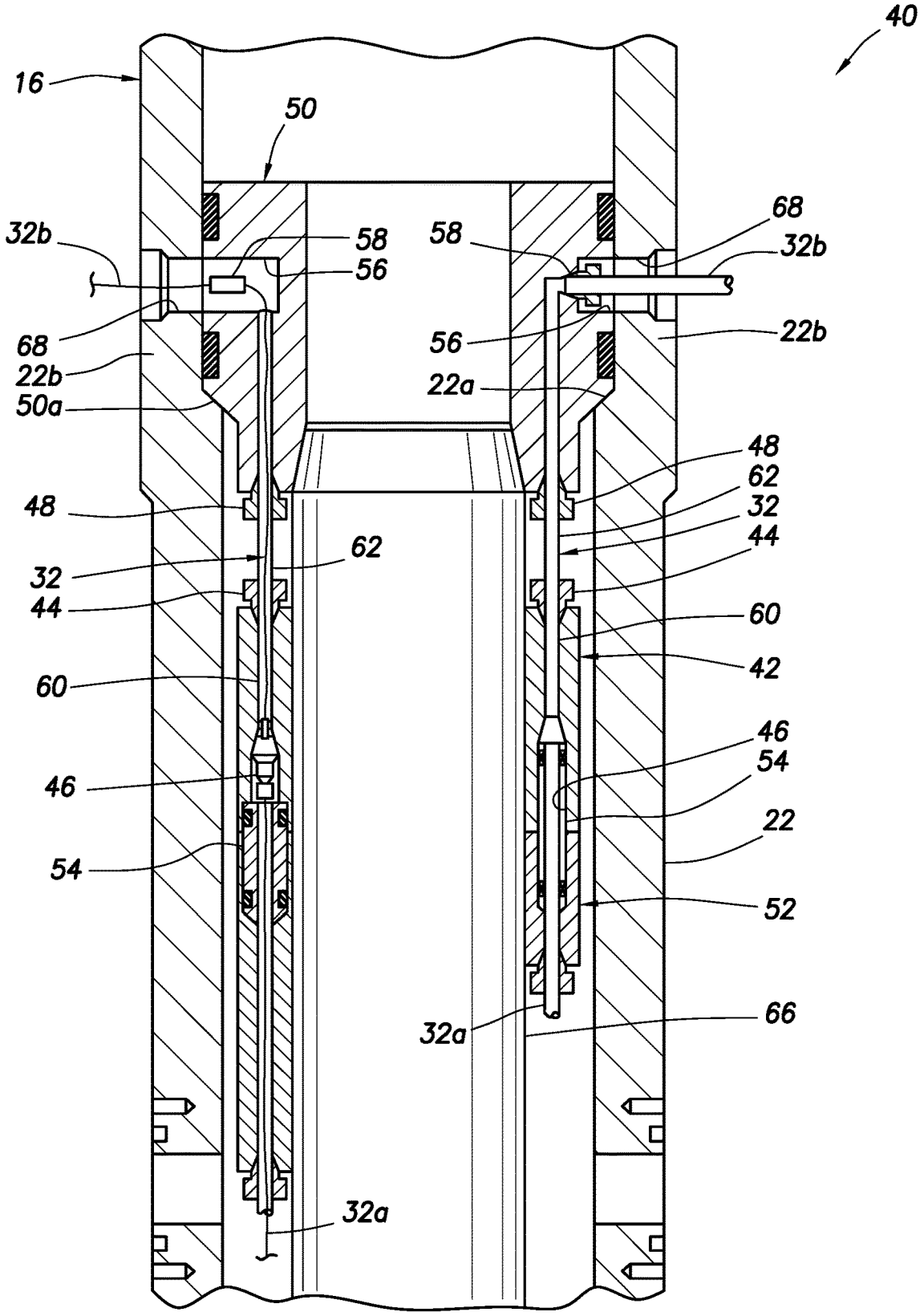
FIG. 5 is a representative cross-sectional view of the assembled hanger, alignment manifold, connector and downhole lines installed in a wellhead assembly.

As depicted in FIG. 5, the alignment manifold 42, hanger 50, connector 52 and tubular 66 are installed in the wellhead assembly 16. The hanger 50 and tubular 66 may be installed when the casing string 28 is conveyed into the wellbore 12, and prior to cementing the casing string in the wellbore.

In this example, the hanger 50 has an external shoulder 50*a* that engages an internal shoulder 22*a* in the housing 22, so that further downward displacement of the hanger 50 through the housing 22 is prevented, thereby suspending the tubular 66 (and the attached casing string 28 if used with the FIG. 1 well system 10). However, the scope of this disclosure is not limited to any particular technique for suspending the tubular 66 using the hanger 50.

Note that, when appropriately positioned in the housing 22, the openings 56 in the hanger 50 align with openings 68 formed through a sidewall 22*b* of the housing 22. In this manner, the surface lines 32*b* can extend through the aligned openings 56, 68. The connectors 58 may be used to connect the surface lines 32*b* to the lines 32 extending through the hanger 50 and the alignment manifold 42.

The surface lines 32*b* are now connected to the respective downhole lines 32*a*. This provides for communication between the downhole tool 30 and the surface equipment 34 in the FIG. 1 well system 10. In other examples, the principles of this disclosure could be used to provide for communication with a sensor or other equipment within the wellhead assembly 16, or to a type of equipment other than a downhole tool.

Figure 6:
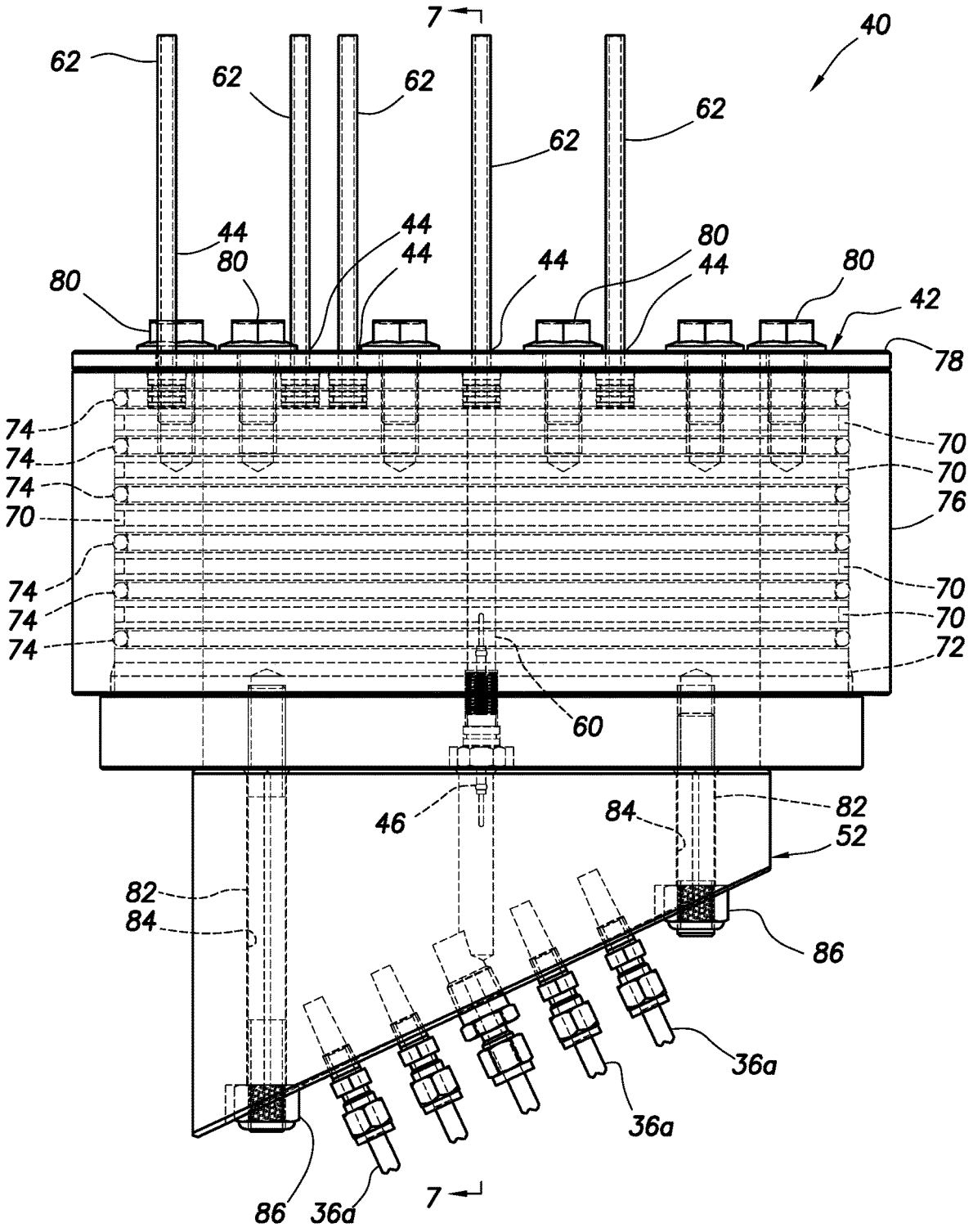
FIG. 6 is a representative side view of another example of the alignment manifold and connector.
Figure 7:
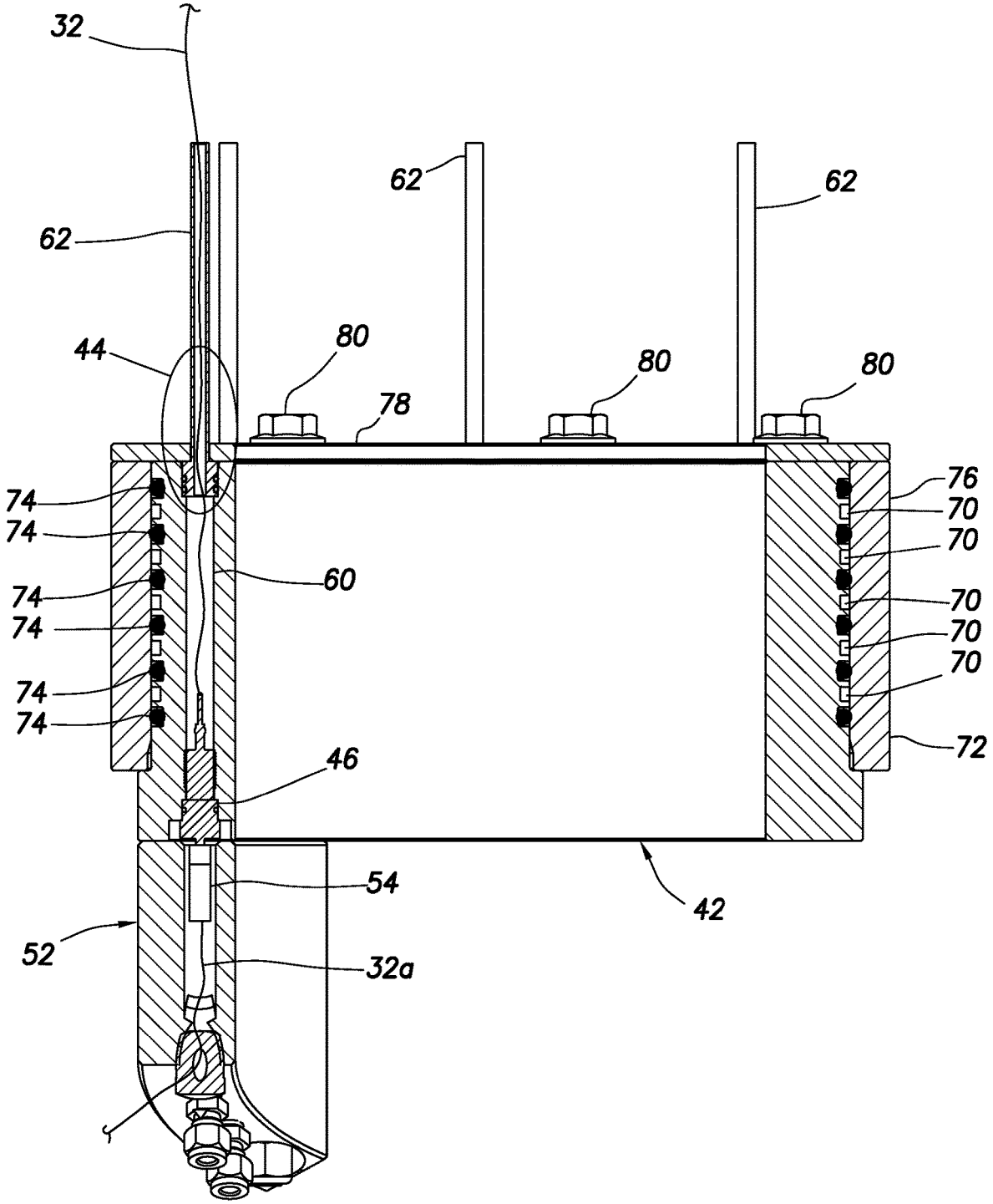
FIG. 7 is a representative cross-sectional view of the alignment manifold and connector, taken along line 7-7 of FIG. 6.

Referring additionally now to FIGS. 6 & 7, another example of the system 40 is representatively illustrated. In this example, the alignment manifold upper terminals 44 have the tubes 62 extending outwardly therefrom. The tubes 62 are appropriately positioned to align with and sealingly engage the terminals 48 of the hanger 50.

However, some of the lower terminals 46 in the alignment manifold 42 are not aligned with the upper terminals 44, and so the conduits 60 cannot extend straight between these misaligned terminals 44, 46. To provide for communication between the misaligned terminals 44, 46, the alignment manifold 42 includes annular chambers 70, which can be communicated with at any rotational position by, for example, drilling appropriately positioned holes 73 (not visible in FIGS. 6 & 7, see FIG. 8) intersected by holes extending to the respective terminals 44, 46.

In the FIGS. 6 & 7 example, the annular chambers 70 are formed as recesses on a manifold body 72 separated by seals 74. An outer sleeve 76 encloses the annular chambers 70. The outer sleeve 76 and the tubes 62 are secured to the manifold body 72 by an upper plate 78 and fasteners 80.

Note that one of the conduits 60 depicted in cross-section in FIG. 7 extends straight axially through the alignment manifold 42 between the terminals 44, 46. Such a straight conduit 60 may be useful for passing optical or electrical conductors through the alignment manifold 42 between the terminals 44, 46. Any rotationally offset or otherwise misaligned respective terminals 44, 46 may be connected via one of the annular chambers 70 (e.g., appropriately positioned holes 73 could be drilled to communicate each of the respective terminals 44, 46 to the same annular chamber 70).

Figure 8:
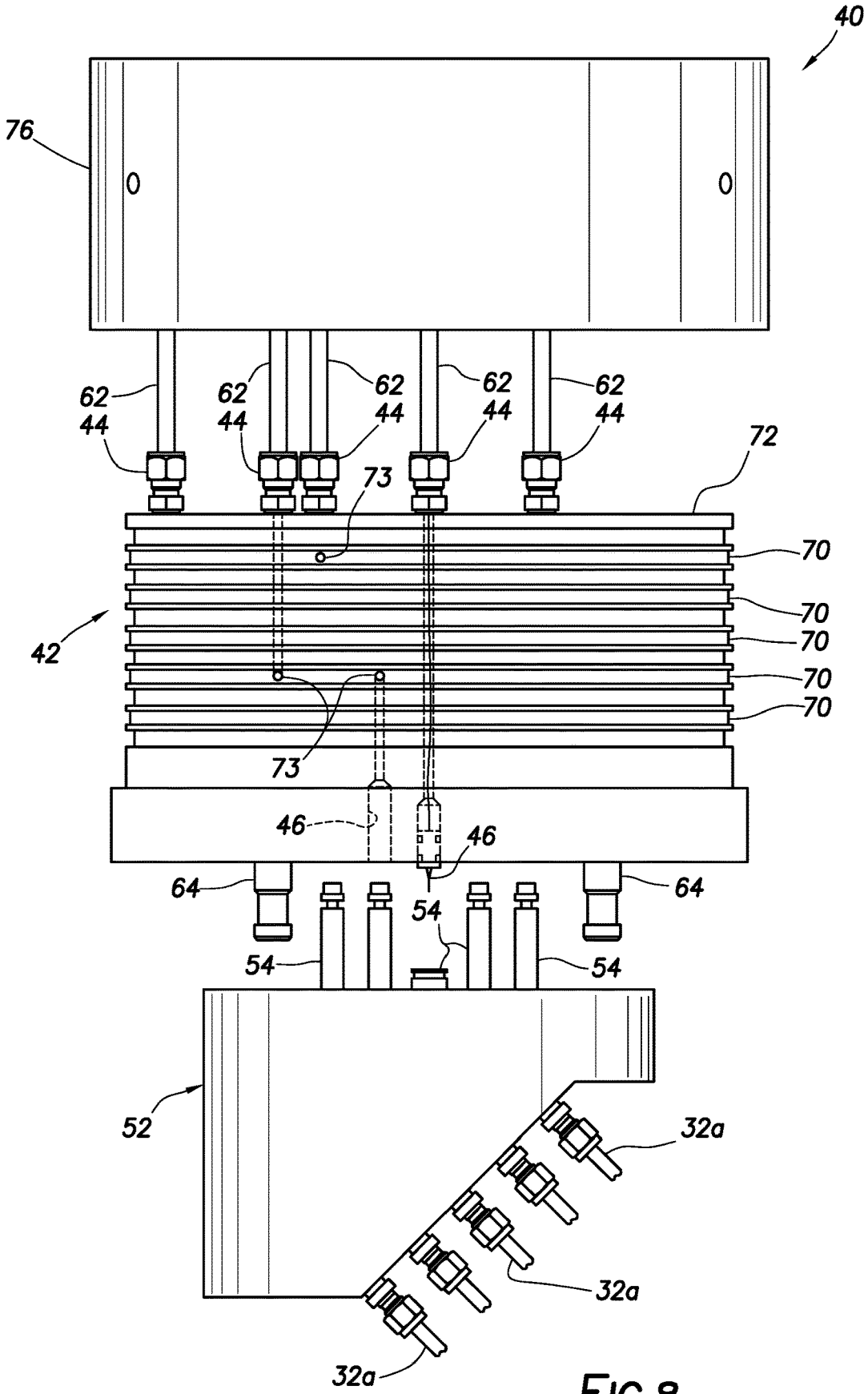
FIG. 8 is a representative exploded side view of another example of the alignment manifold and connector.

Referring additionally now to FIGS. 8-11, another example of the communication system 40 is representatively illustrated. In FIG. 8, the alignment manifold 42 and connector 52 are depicted in an exploded view, with the outer sleeve 76 spaced away from the manifold body 72, and the alignment manifold 42 spaced away from the connector 52.

In this view, the manner in which the holes 73 can provide for fluid communication between the respective terminals 44, 46, no matter whether the terminals are rotationally offset relative to one another, can be more clearly seen. By connecting the respective terminals 44, 46 to the same annular chamber 70, communication is provided between the respective terminals 44, 46.

Figure 9:
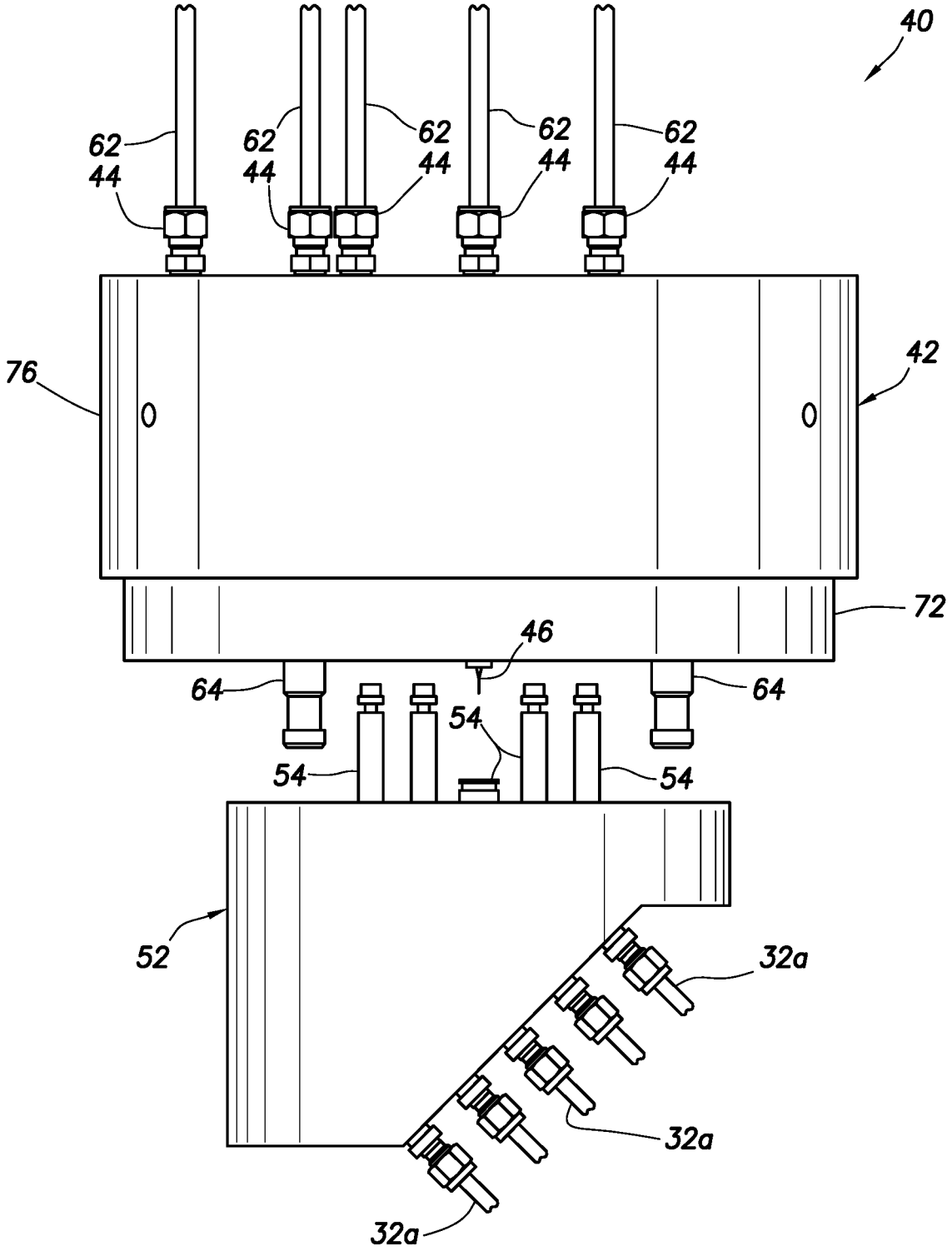
FIG. 9 is a representative side view of the alignment manifold in preparation for connecting to the connector.

In FIG. 9, the outer sleeve 76 has been secured on the manifold body 72. The alignment manifold 42 can be connected to the hanger 50 at this point, for example, by connecting the tubes 62 to the respective terminals 48 of the hanger 50. Note that the alignment manifold 42 can be connected to the hanger 50 away from the open well, and can be pressure tested prior to being brought to the rig floor 36 or positioned over the open well.

Figure 10:
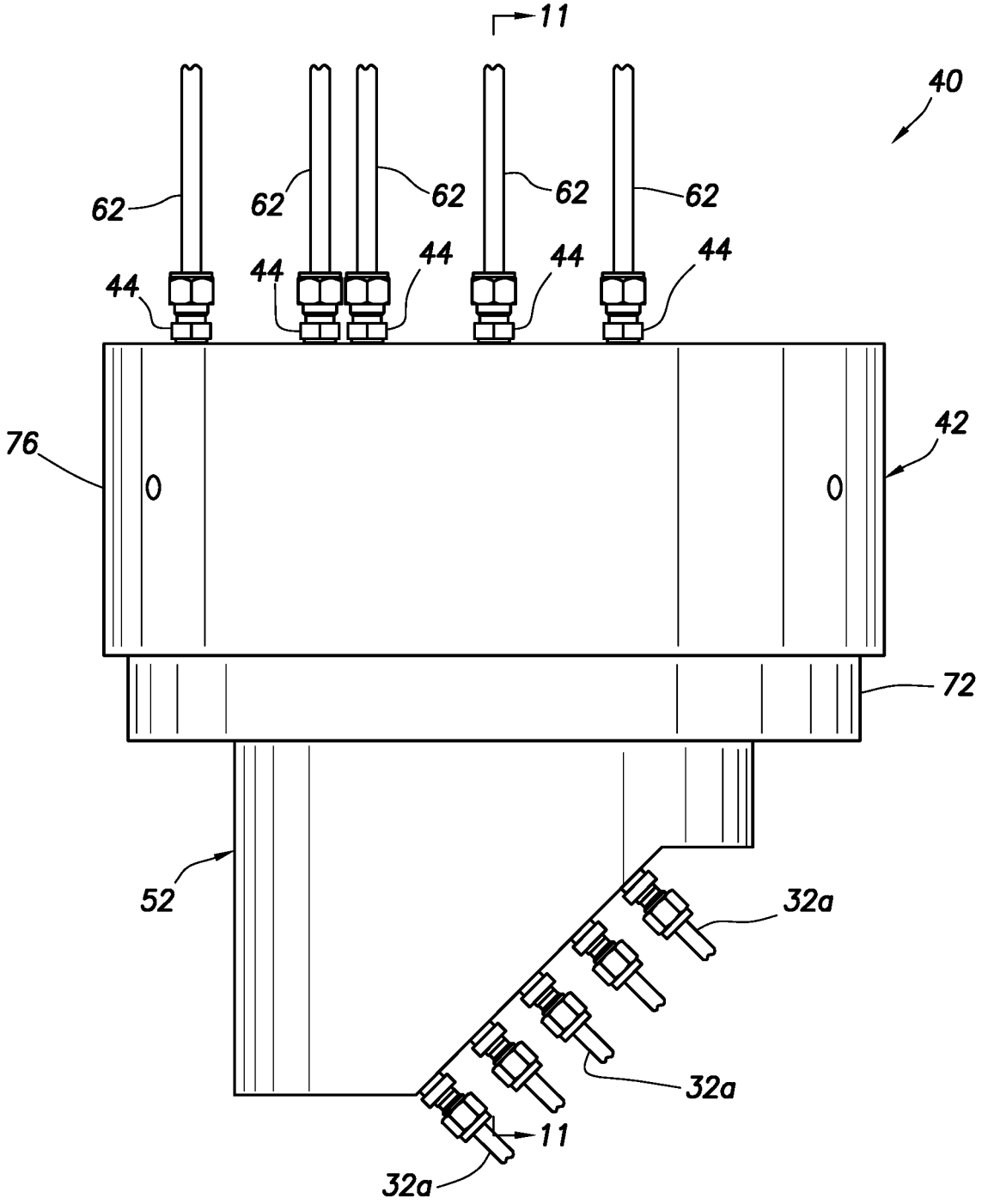
FIG. 10 is a representative side view of the alignment manifold connected to the connector.

In FIG. 10, the connector 52 is connected to the alignment manifold 42. This step is, in this example, performed after the alignment manifold 42 is connected to the hanger 50, and after the connector 52 is connected to the downhole lines 32*a*. This step can be performed after the tubular 66 has been connected to the hanger 50, and after the tubular 66 has been connected as an uppermost section of the casing string 28 in the FIG. 1 system 10.

Figure 11:
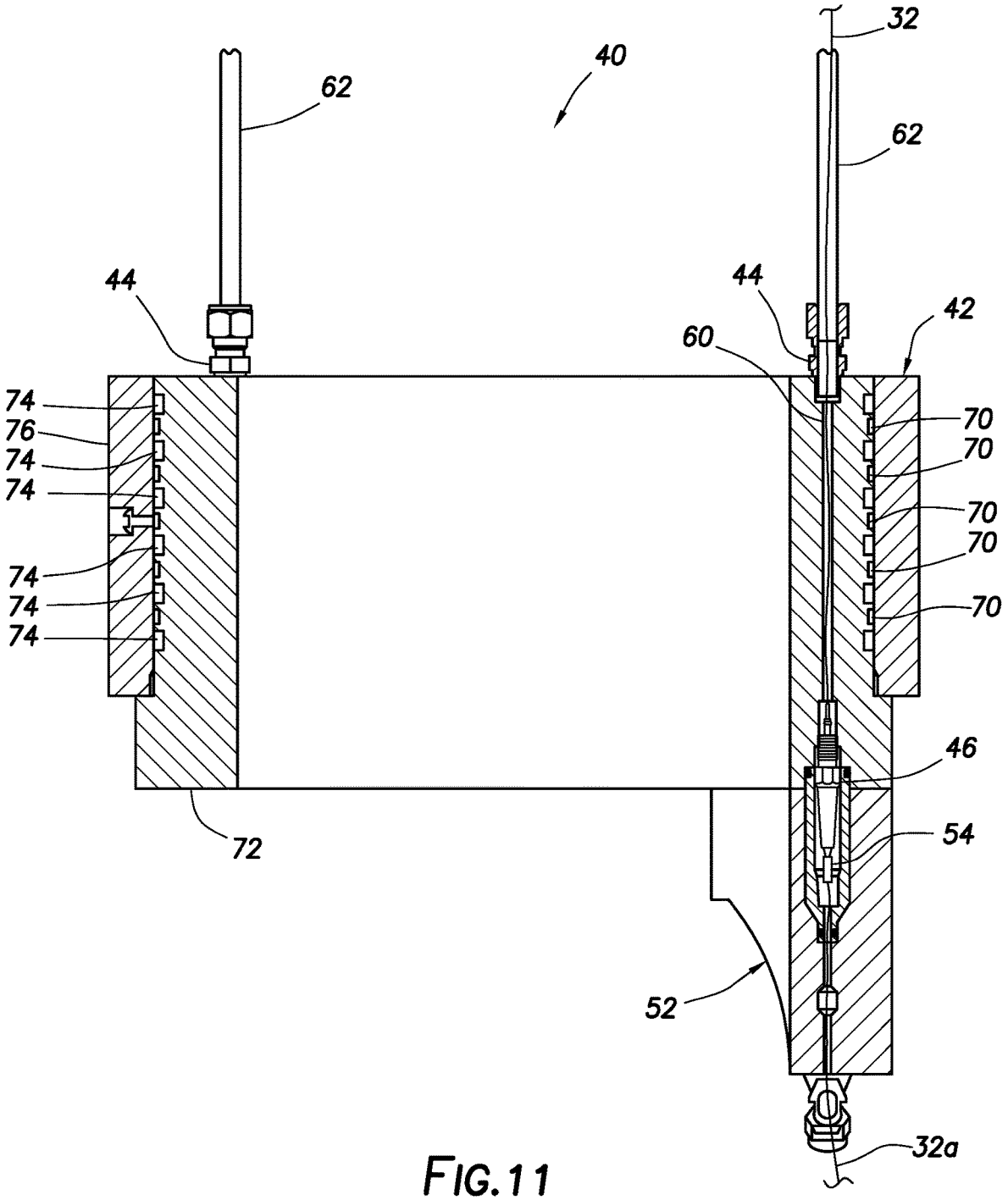
FIG. 11 is a representative cross-sectional view of the alignment manifold and connector, taken along line 11-11 of FIG. 10.

In FIG. 11, a cross-sectional view of the connected alignment manifold 42 and connector 52 is representatively illustrated. Similar to the example of FIG. 7, one of the conduits 60 depicted in cross-section in FIG. 11 extends straight axially through the alignment manifold 42 between the terminals 44, 46. Such a straight conduit 60 may be useful for passing optical or electrical conductors through the alignment manifold 42 between the terminals 44, 46. Any rotationally offset or otherwise misaligned respective terminals 44, 46 may be connected via one of the annular chambers 70 (e.g., appropriately positioned holes 73 could be drilled to communicate each of the respective terminals 44, 46 to the same annular chamber 70).

Figure 12:
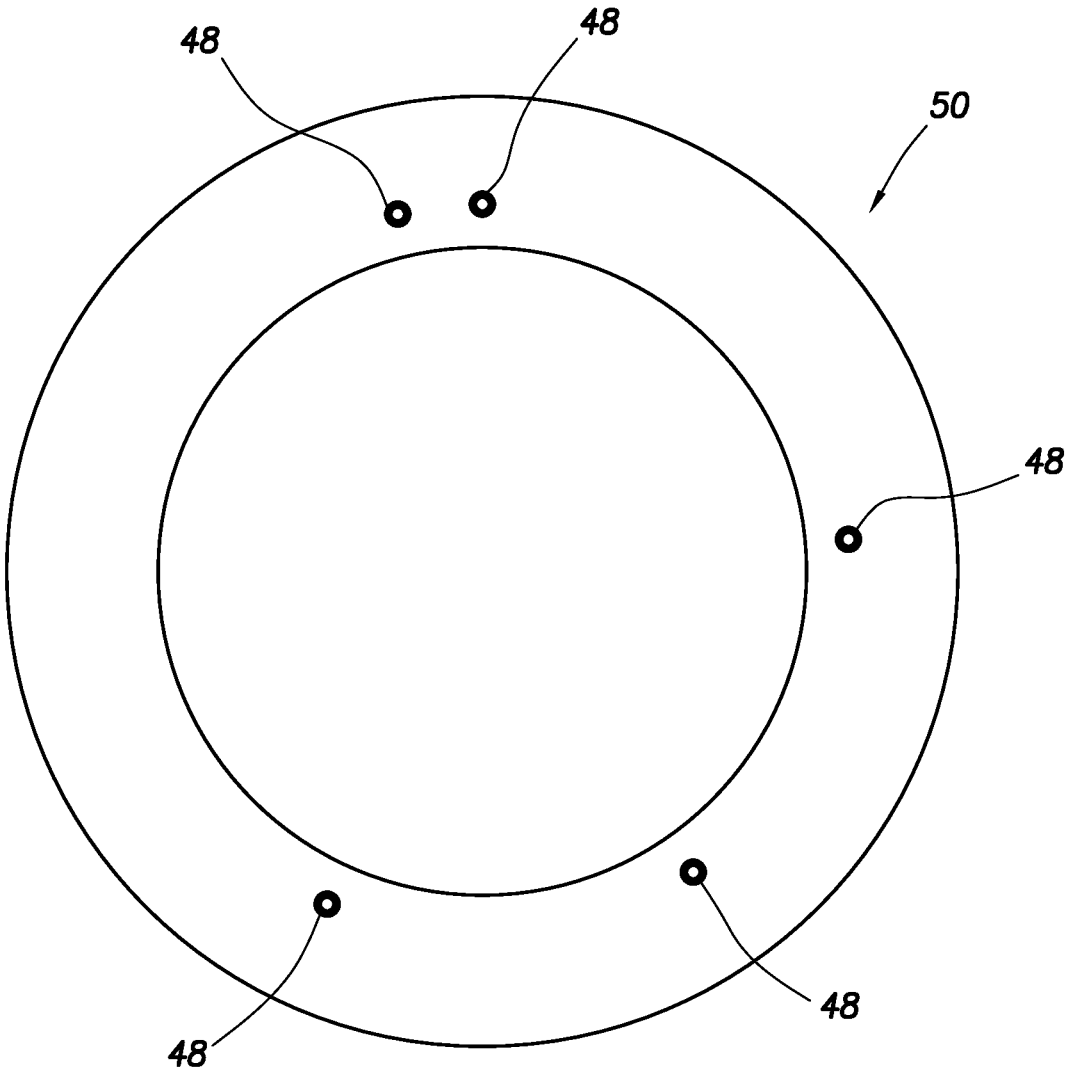
FIG. 12 is a representative bottom view of an example of the hanger.

Referring additionally now to FIG. 12, a bottom view of an example of the hanger 50 is representatively illustrated. Note that the hanger terminals 48 are unevenly distributed on a lower side of the hanger 50. In other examples, the hanger terminals 48 could be distributed differently on the lower side of the hanger 50.

The alignment manifolds 42 described herein can be configured so that the upper alignment manifold terminals 44 are complementarily positioned relative to the hanger terminals 48. In this manner, the alignment manifold 42 and hanger 50 can be readily connected to each other (preferably away from the open well, such as, away from the open housing 22 of the wellhead 16).

Figure 13:
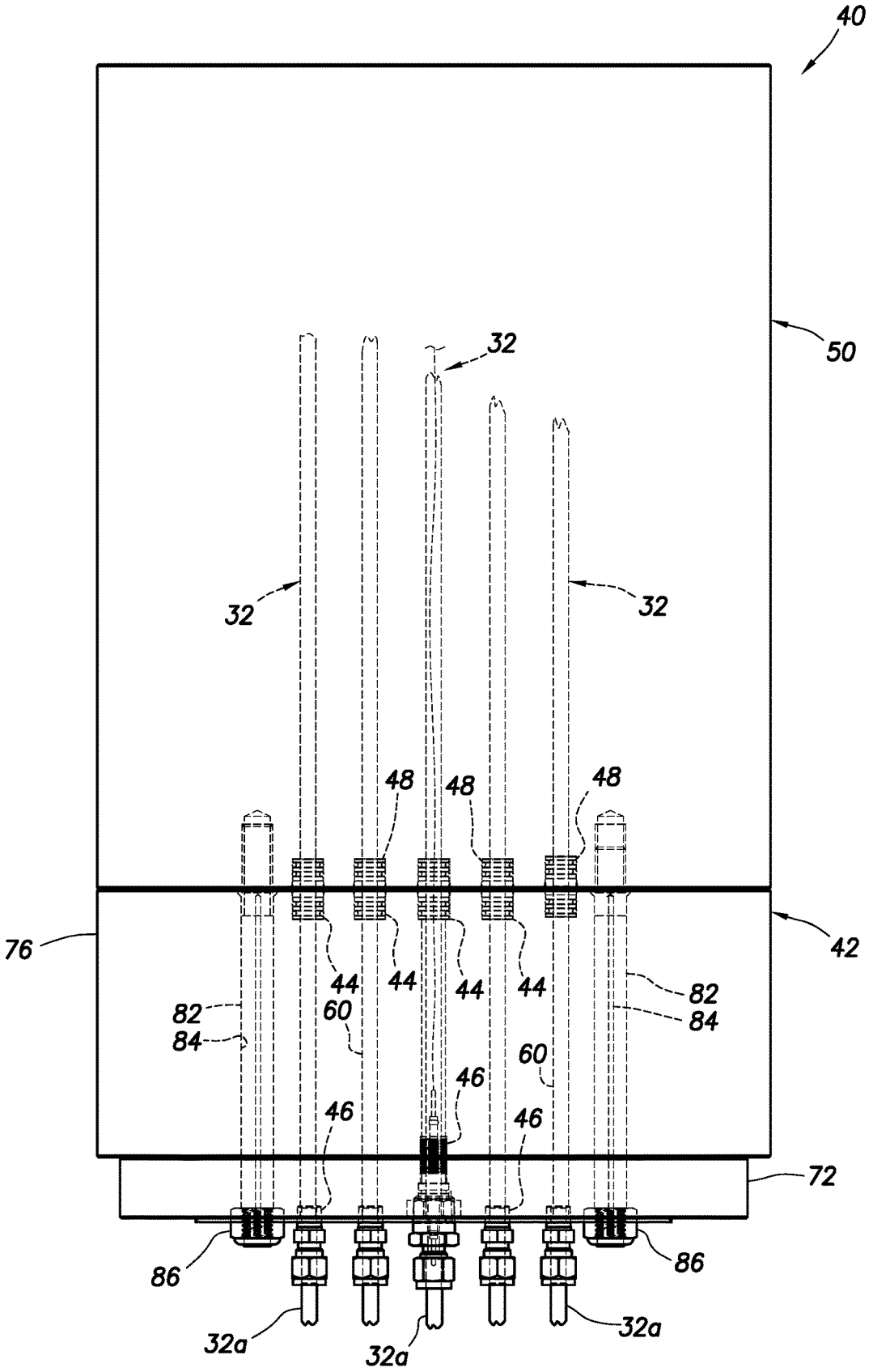
FIG. 13 is a representative side view of another example of the assembled alignment manifold and hanger.

Referring additionally now to FIG. 13, another example of the alignment manifold 42 and hanger 50 is representatively illustrated. In this example, the downhole lines connector 52 is not used. Instead, the downhole lines 32*a* are connected directly to the alignment manifold 42.

Note that, although all of the conduits 60 in the alignment manifold 42 depicted in FIG. 13 extend straight axially between the terminals 44, 46, in other examples the respective terminals 44, 46 may not be axially aligned (e.g., the terminals 44, 46 could be radially or rotationally offset from each other). The annular chambers 70, seals 74 and holes 73 (see FIG. 8) may be used to provide for communication between respective pairs of the terminals 44, 46 when they are not axially aligned.

The alignment manifold 42 is secured to the hanger 50 by means of the threaded shafts 82, bores 84 and nuts 86, in this example. When the alignment manifold 42 and the hanger 50 are secured together, the respective terminals 44, 48 are placed in communication, thereby extending the lines 32 through the connected alignment manifold and hanger.

Figure 14:
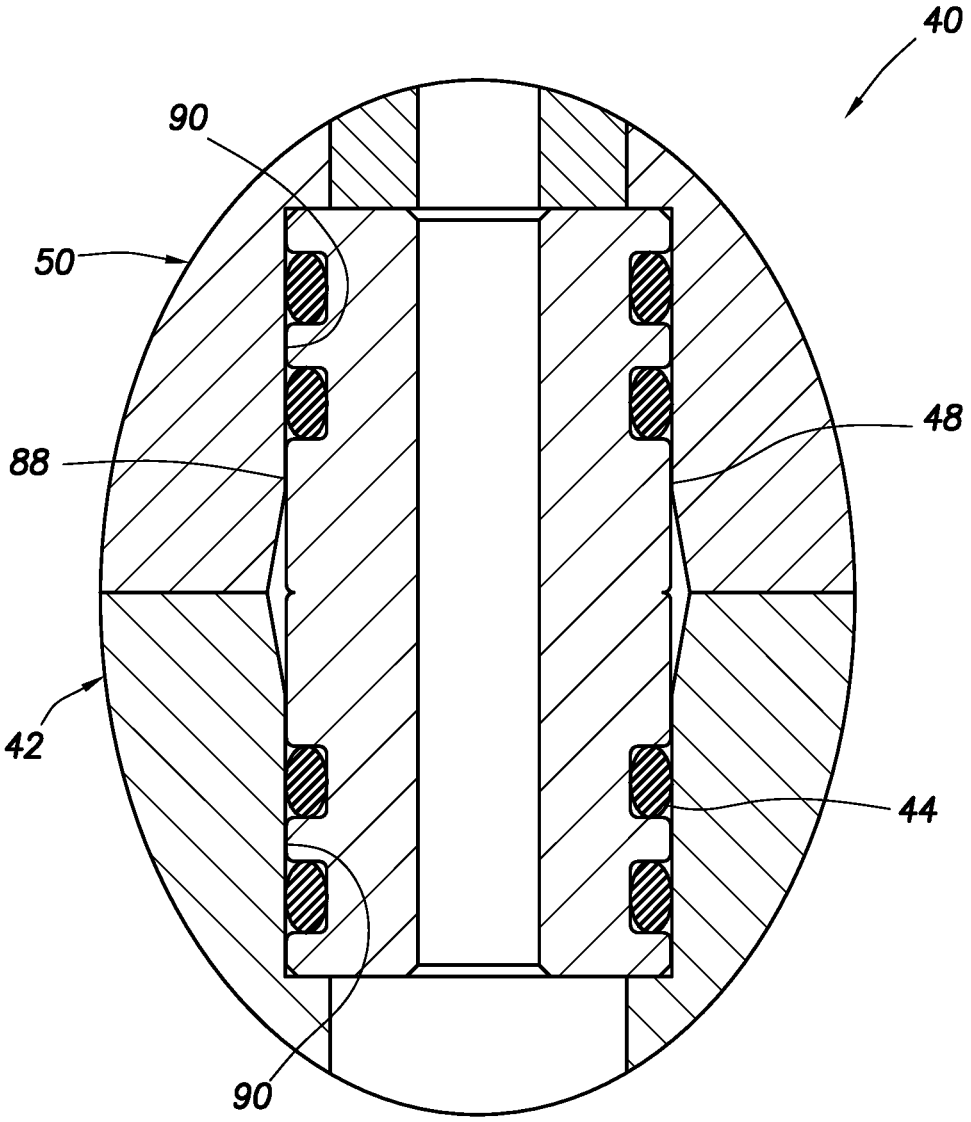
FIG. 14 is a representative cross-sectional view of connected terminals of the FIG. 13 alignment manifold and hanger.

Referring additionally now to FIG. 14, a cross-sectional view of an example of one of the connected pairs of terminals 44, 48 is representatively illustrated. In this example, a relatively short tube 88 is sealingly received in seal bores 90 formed in the hanger 50 and alignment manifold 42. Thus, the terminal 48 comprises an upper end of the tube 88 received in the seal bore 90 in the hanger 50, and the terminal 44 comprises a lower end of the tube 88 received in the seal bore 90 in the alignment manifold 42.

Note that the alignment manifold 42 is not spaced apart from the hanger 50. Separate tubes 62 are not used extending axially between the alignment manifold 42 and the hanger 50, as in the examples of FIGS. 2 & 4-11.

It may now be fully appreciated that the above disclosure provides significant advancements to the art of designing, constructing and implementing techniques for communicating through wellhead assemblies. In examples described above, an alignment manifold can be used to connect to a hanger that suspends a tubular from a wellhead assembly. The alignment manifold can adapt between hanger connections and a connector for lines (such as, lines extending to one or more downhole tools). In this manner, the alignment manifold and connector can be conveniently connected when the hanger is installed in the wellhead assembly.

A system 40 for communicating through a sidewall 22*b* of a wellhead assembly 16 is provided to the art by the above disclosure. In one example, the system 40 can include an alignment manifold 42 having first and second terminals 44, 46 positioned on opposite respective sides of the alignment manifold 42. Each of the first terminals 44 is in communication with a respective one of the second terminals 46. A downhole line connector 52 is configured to connect to downhole lines 32*a*. The downhole line connector 52 includes terminals 54 aligned with the second terminals 46 of the alignment manifold 42.

The alignment manifold first terminals 44 may be aligned with terminals 48 of a hanger 50 configured to suspend a tubular 66 from the wellhead assembly 16.

The hanger terminals 48 may be connected to lines 32*b* extending through the sidewall 22*b* of the wellhead assembly 16.

At least one of the alignment manifold first terminals 44 may be rotationally offset from the respective one of the alignment manifold second terminals 46.

The downhole lines 32*a* may extend to at least one downhole tool 30 in a well.

A method of communicating through a sidewall 22*b* of a wellhead assembly 16 is also provided to the art by the above disclosure. In one example, the method can include connecting an alignment manifold 42 to a hanger 50, the hanger 50 being configured to suspend a tubular 66 from the wellhead assembly 16, and connecting a downhole line connector 52 to the alignment manifold 42.

Communication may be provided between at least one surface line 32*b* and at least one downhole line 32*a*, as a result of the connecting of the downhole line connector 52 to the alignment manifold 42.

The method may include pressure testing the connected alignment manifold 42 and hanger 50, prior to the connecting of the downhole line connector 52 to the alignment manifold 42.

The pressure testing may be performed prior to or after connecting the hanger 50 to the tubular 66. The connecting of the alignment manifold 42 to the hanger 50 may be performed prior to or after connecting the hanger 50 to the tubular 66.

The method may include connecting one or more downhole lines 32*a* to the downhole line connector 52. The connecting of the downhole lines 32*a* to the downhole line connector 52 may be performed after the connecting of the alignment manifold 42 to the hanger 50. The connecting of the downhole lines 32*a* to the downhole line connector 52 may be performed prior to the connecting of the downhole line connector 52 to the alignment manifold 42.

One example of a system 40 for communicating through a sidewall 22*b* of a wellhead assembly 16 described above can include an alignment manifold 42 configured to align first terminals 44 of the alignment manifold 42 with terminals 48 of a hanger 50, a line connector 52 configured to connect to lines 32, the line connector 52 including terminals 54 aligned with second terminals 46 of the alignment manifold 42, and connection of the alignment manifold 42 to the line connector 52 provides communication between the line connector terminals 54 and the alignment manifold first terminals 44.

At least one of the alignment manifold first terminals 44 may be rotationally offset from a respective one of the alignment manifold second terminals 46.

The lines 32 may extend to at least one downhole tool 30 in a well.

The hanger 50 may be configured to suspend a tubular 66 from the wellhead assembly 16.

The hanger terminals 48 may be connected to lines 32*b* extending through the sidewall 22*b* of the wellhead assembly 16.

A system 40 for communicating through a hanger 50 can include an alignment manifold 42 having first and second terminals 44, 46 positioned on opposite respective sides of the alignment manifold 42, each of the first terminals 44 being in communication with a respective one of the second terminals 46; and a downhole line connector 52 configured to connect to downhole lines 32*a*, the downhole line connector 52 including terminals 54 aligned with the second terminals 46 of the alignment manifold 42.

The alignment manifold first terminals 44 may be aligned with terminals 48 of the hanger 50, the hanger 50 being configured to suspend a tubular 66 from a wellhead assembly 16.

The hanger terminals 48 may be connected to lines 32*b* extending through a sidewall 22*b* of a wellhead assembly 16.

At least one of the alignment manifold first terminals 44 may be rotationally offset from the respective one of the alignment manifold second terminals 46.

A method of communicating through a hanger 50 can include constructing an alignment manifold 42 for complementary connection to the hanger 50; and connecting the alignment manifold 42 to the hanger 50, the hanger 50 being configured to suspend a tubular 66 from a wellhead assembly 16, and the connecting comprising extending multiple lines 32 through the connected alignment manifold 42 and hanger 50.

The connecting of the alignment manifold 42 to the hanger 50 may be performed prior to or after connecting the hanger 50 to the tubular 66.

The method can include connecting a downhole line connector 52 to the alignment manifold 42.

The multiple lines 32 may comprise at least one surface line 32*b* and at least one respective downhole line 32*a*. Communication may be provided between the at least one surface line 32*b* and the at least one downhole line 32*a*, as a result of the connecting of the downhole line connector 52 to the alignment manifold 42.

The multiple lines 32 may comprise a plurality of respective pairs of surface lines 32*b* and downhole lines 32*a*. Communication may be provided between the plurality of respective pairs of surface lines 32*b* and downhole lines 32*a*, as a result of the connecting of the downhole line connector 52 to the alignment manifold 42.

Communication may be provided between at least one terminal 54 of the downhole line connector 52 and at least one respective terminal 48 in the hanger 50, as a result of the connecting of the downhole line connector 52 to the alignment manifold 42, the at least one terminal 54 of the downhole line connector 52 and the at least one terminal 48 in the hanger 50 being rotationally offset relative to each other.

The method may include pressure testing the connected alignment manifold 42 and hanger 50, prior to the connecting of the downhole line connector 52 to the alignment manifold 42. The pressure testing may be performed prior to or after connecting the hanger 50 to the tubular 66.

The method may include connecting one or more downhole lines 32*a* to the downhole line connector 52. The connecting of the downhole lines 32*a* to the downhole line connector 52 may be performed after the connecting of the alignment manifold to the hanger. The connecting of the downhole lines 32*a* to the downhole line connector 52 may be performed prior to the connecting of the downhole line connector 52 to the alignment manifold 42.

A system 40 for communicating through a hanger 50 can include an alignment manifold 42 configured to align first terminals 44 of the alignment manifold 42 with terminals 48 of the hanger 50. Second terminals 46 of the alignment manifold 42 are in communication with respective ones of the first terminals 44, and at least one of the second terminals 46 is rotationally offset relative to the respective at least one of the first terminals 44.

The system 40 can include a line connector 52 configured to connect to lines 32, the line connector 52 including terminals 54 aligned with the second terminals 46 of the alignment manifold 42. Connection of the alignment manifold 42 to the line connector 52 provides communication between the line connector terminals 54 and the alignment manifold first terminals 44.

The hanger terminals 48 may be connected to lines 32*b* extending through a sidewall 22*b* of the wellhead assembly 16.

A method of communicating through a hanger 50 can include constructing an alignment manifold 42 for complementary engagement with the hanger 50; and connecting a downhole line connector 52 to the alignment manifold 42, the downhole line connector 52 being connected to multiple downhole lines 32*a*.

Communication may be provided between at least one of multiple surface line 32*b* and at least one of the downhole lines 32*a*, as a result of the connecting of the downhole line connector 52 to the alignment manifold 42.

Communication may be provided between a plurality of respective pairs of the surface lines 32*b* and the downhole lines 32*a*, as a result of the connecting of the downhole line connector 52 to the alignment manifold 42.

Communication may be provided between at least one terminal 54 of the downhole line connector 52 and at least one respective terminal 48 in the hanger 50, as a result of the connecting of the downhole line connector 52 to the alignment manifold 42, the at least one terminal 54 of the downhole line connector 52 and the at least one terminal 48 in the hanger 50 being rotationally offset relative to each other.

The method may include connecting the alignment manifold 42 to the hanger 50. Connecting of the alignment manifold 42 to the hanger 50 may be performed prior to or after connecting the hanger 50 to the tubular 66.

The method may include pressure testing the connected alignment manifold 42 and hanger 50. The pressure testing may be performed prior to the connecting of the downhole line connector 52 to the alignment manifold 42. The pressure testing may be performed prior to or after connecting the hanger 50 to the tubular 66.

Connecting the downhole lines 32*a* to the downhole line connector 52 may be performed after the connecting of the alignment manifold 42 to the hanger 50. Connecting the downhole lines 32*a* to the downhole line connector 52 may be performed prior to the connecting of the downhole line connector 52 to the alignment manifold 42.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A system for communicating through a hanger, the system comprising:

an alignment manifold which is configured to be positioned below the hanger, the alignment manifold having first and second terminals positioned on opposite respective sides of the alignment manifold, each of the first terminals being in communication with a respective one of the second terminals; and a downhole line connector which is configured to connect downhole lines to the alignment manifold, the downhole line connector including terminals aligned with the second terminals of the alignment manifold.

2. The system of claim 1, in which the alignment manifold first terminals are aligned with terminals of the hanger, the hanger being configured to suspend a tubular from a wellhead assembly.

3. The system of claim 2, in which the hanger terminals are connected to lines extending through a sidewall of the wellhead assembly.

4. The system of claim 1, in which at least one of the alignment manifold first terminals is rotationally offset from the respective one of the alignment manifold second terminals.

5. The system of claim 1, in which the downhole lines extend to at least one downhole tool in a well.

6. A method of communicating through a hanger, the method comprising:

constructing an alignment manifold for complementary connection to the hanger; and connecting the alignment manifold to the hanger, the hanger being configured to suspend a tubular from a wellhead assembly, the alignment manifold being configured to surround the tubular, and the connecting comprising extending multiple lines through the connected alignment manifold and hanger.

7. The method of claim 6, in which the connecting of the alignment manifold to the hanger is performed prior to connecting the hanger to the tubular.

8. The method of claim 6, in which the connecting of the alignment manifold to the hanger is performed after connecting the hanger to the tubular.

9. The method of claim 6, further comprising connecting a downhole line connector to the alignment manifold.

10. The method of claim 9, in which the multiple lines comprise at least one surface line and at least one respective downhole line, and in which communication is provided between the at least one surface line and the at least one downhole line, as a result of the connecting of the downhole line connector to the alignment manifold.

11. The method of claim 9, in which the multiple lines comprise a plurality of respective pairs of surface lines and downhole lines, and in which communication is provided between the plurality of respective pairs of surface lines and downhole lines, as a result of the connecting of the downhole line connector to the alignment manifold.

12. The method of claim 9, in which communication is provided between at least one terminal of the downhole line connector and at least one respective terminal in the hanger, as a result of the connecting of the downhole line connector to the alignment manifold, the at least one terminal of the downhole line connector and the at least one terminal in the hanger being rotationally offset relative to each other.

13. The method of claim 9, further comprising pressure testing the connected alignment manifold and hanger, prior to the connecting of the downhole line connector to the alignment manifold.

14. The method of claim 13, in which the pressure testing is performed prior to connecting the hanger to the tubular.

15. The method of claim 13, in which the pressure testing is performed after connecting the hanger to the tubular.

16. The method of claim 9, further comprising connecting one or more downhole lines to the downhole line connector.

17. The method of claim 16, in which the connecting of the downhole lines to the downhole line connector is performed after the connecting of the alignment manifold to the hanger.

18. The method of claim 16, in which the connecting of the downhole lines to the downhole line connector is performed prior to the connecting of the downhole line connector to the alignment manifold.

19. A system for communicating through a hanger, the system comprising:

an alignment manifold configured to align first terminals of the alignment manifold with lower terminals of the hanger, and in which second terminals of the alignment manifold are in communication with respective ones of the first terminals, the first and second terminals being positioned on opposite respective sides of the alignment manifold, and at least one of the second terminals is rotationally offset relative to the respective at least one of the first terminals.

20. The system of claim 19, further comprising a line connector configured to connect to lines, the line connector including terminals aligned with the second terminals of the alignment manifold, and in which connection of the alignment manifold to the line connector provides communication between the line connector terminals and the alignment manifold first terminals.

21. The system of claim 20, in which the lines extend to at least one downhole tool in a well.

22. The system of claim 19, in which the hanger is configured to suspend a tubular from a wellhead assembly.

23. The system of claim 22, in which the hanger terminals are connected to lines extending through a sidewall of the wellhead assembly.

24. A method of communicating through a hanger, the method comprising:

constructing an alignment manifold for complementary engagement with lower terminals of the hanger; and connecting a downhole line connector to the alignment manifold, the downhole line connector being connected to multiple downhole lines.

25. The method of claim 24, further comprising the hanger suspending a tubular from a wellhead assembly.

26. The method of claim 24, in which communication is provided between at least one of multiple surface lines and at least one of the downhole lines, as a result of the connecting of the downhole line connector to the alignment manifold.

27. The method of claim 26, in which communication is provided between a plurality of respective pairs of the surface lines and the downhole lines, as a result of the connecting of the downhole line connector to the alignment manifold.

28. The method of claim 24, in which communication is provided between at least one terminal of the downhole line connector and at least one respective terminal of the hanger, as a result of the connecting of the downhole line connector to the alignment manifold, the at least one terminal of the downhole line connector and the at least one terminal of the hanger being rotationally offset relative to each other.

29. The method of claim 24, further comprising connecting the alignment manifold to the hanger.

30. The method of claim 29 further comprising pressure testing the connected alignment manifold and hanger.

31. The method of claim 30, in which the pressure testing is performed prior to the connecting of the downhole line connector to the alignment manifold.

32. The method of claim 30, in which the pressure testing is performed prior to connecting the hanger to the tubular.

33. The method of claim 30, in which the pressure testing is performed after connecting the hanger to the tubular.

34. The method of claim 29, in which the connecting of the alignment manifold to the hanger is performed prior to connecting the hanger to the tubular.

35. The method of claim 29, in which the connecting of the alignment manifold to the hanger is performed after connecting the hanger to the tubular.

36. The method of claim 29, further comprising connecting the downhole lines to the downhole line connector after the connecting of the alignment manifold to the hanger.

37. The method of claim 29, further comprising connecting the downhole lines to the downhole line connector prior to the connecting of the downhole line connector to the alignment manifold.

* * * * *